US009576476B2

(12) United States Patent
Yang

(10) Patent No.: US 9,576,476 B2
(45) Date of Patent: Feb. 21, 2017

(54) METHOD AND ELECTRONIC DEVICE FOR CONTROLLING PERIPHERAL DEVICE

(71) Applicant: MEDIATEK INC., Hsin-Chu (TW)

(72) Inventor: Lin-Hao Yang, New Taipei (TW)

(73) Assignee: MEDIATEK INC., Hsin-Chu (TW)

( * ) Notice: Subject to any disclaimer, the term of this patent is extended or adjusted under 35 U.S.C. 154(b) by 218 days.

(21) Appl. No.: 14/558,743

(22) Filed: Dec. 3, 2014

(65) Prior Publication Data

US 2016/0163188 A1 Jun. 9, 2016

(51) Int. Cl.
*G08C 17/02* (2006.01)

(52) U.S. Cl.
CPC ..... *G08C 17/02* (2013.01); *G08C 2201/20* (2013.01); *G08C 2201/91* (2013.01); *G08C 2201/93* (2013.01)

(58) Field of Classification Search
CPC ..... G08C 17/02; G08C 2201/20; G08C 19/28; G08C 2201/92; G08C 23/04; G08C 2201/71; G08C 2201/21; G08C 2201/40
USPC ..... 340/13.21
See application file for complete search history.

(56) References Cited

U.S. PATENT DOCUMENTS 8,429,435 B1 * 4/2013 Clayton ..... H04L 12/10 700/19
8,548,607 B1 * 10/2013 Belz ..... G05B 15/02 700/11
8,581,439 B1 * 11/2013 Clayton ..... H02J 9/00 307/23
2015/0373091 A1 * 12/2015 Sanghavi ..... H04W 4/206 709/204
2016/0156768 A1 * 6/2016 Kim ..... H04L 67/12 455/420

* cited by examiner

*Primary Examiner* — Mark Blouin
(74) *Attorney, Agent, or Firm* — Winston Hsu; Scott Margo

(57) ABSTRACT

A method for controlling at least one peripheral device and associated electronic device and control system are provided. The method includes: detecting existence of a first mobile device by checking a wireless connection associated with the first mobile device; and when the existence of the first mobile device is detected, obtaining user data of the first mobile device through the wireless connection, and broadcasting the user data of the first mobile device to the peripheral device(s) for controlling a setting of each peripheral device.

17 Claims, 11 Drawing Sheets

METHOD AND ELECTRONIC DEVICE FOR CONTROLLING PERIPHERAL DEVICE

BACKGROUND

The present invention relates to controlling peripheral devices, and more particularly, to a method for wirelessly controlling at least one peripheral device through an intermediate electronic device.

Wireless entertainment and mobile communications technologies have become more and more important in daily life. Wireless fidelity (Wi-Fi) and Bluetooth techniques are commonly applied in both mobile and household environments. When a user connects an electronic device, such as a smart phone, tablet, or laptop computer, to peripheral devices through a network, it is preferable to make the peripheral devices instantly enter a predetermined mode designated/set by the user based on interest or habits. In order to achieve the desired effect, settings of the peripheral devices must be manually adjusted after the connection between the mobile device and a peripheral device is constructed. More particularly, if more than one peripheral device needs to be adjusted, the manual adjustment becomes inconvenient for the users to do individually, even if the users can wirelessly adjust the peripheral devices by manually operating their mobile devices. The user experience will be lowered due to these cumbersome operations.

Therefore, there is a need for a novel method and electronic device for controlling peripheral devices.

SUMMARY

An objective of the present invention is to provide a method and an associated electronic device for controlling at least one peripheral device.

An embodiment of the present invention provides a method for controlling at least one peripheral device. The method comprises: detecting existence of a first mobile device by checking a wireless connection associated with the first mobile device; and when the existence of the first mobile device is detected, obtaining user data of the first mobile device through the wireless connection, and broadcasting the user data of the first mobile device to the peripheral device for controlling a setting of each peripheral device.

An embodiment of the present invention provides an electronic device for controlling at least one peripheral device. The electronic device comprises a wireless module and a controller. The wireless module is arranged to detect existence of a first mobile device by checking a wireless connection associated with the first mobile device. The controller is arranged to obtain user data of the first mobile device through the wireless connection and broadcast the user data of the first mobile device to the peripheral device when the existence of the first mobile device is detected, to control a setting of each peripheral device.

An embodiment of the present invention provides a control system for controlling a plurality of peripheral devices. The control system comprises a plurality of groups, each having an electronic device and at least one peripheral device. The electronic device has a wireless module and a control module. The wireless module is arranged to detect existence of a mobile device by checking a wireless connection associated with the mobile device. The controller is arranged to obtain user data of the mobile device through the wireless connection and broadcast the user data of the mobile device to the peripheral device in the group to which the electronic device belongs when the existence of the mobile device is detected, to control a setting of each peripheral device in the group to which the electronic device belongs.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should not be interpreted as a close-ended term such as "consist of". Also, the term "couple" is intended to mean either an indirect or direct electrical connection. Accordingly, if one device is coupled to another device, that connection may be through a direct electrical connection, or through an indirect electrical connection via other devices and connections.

Figure 1:
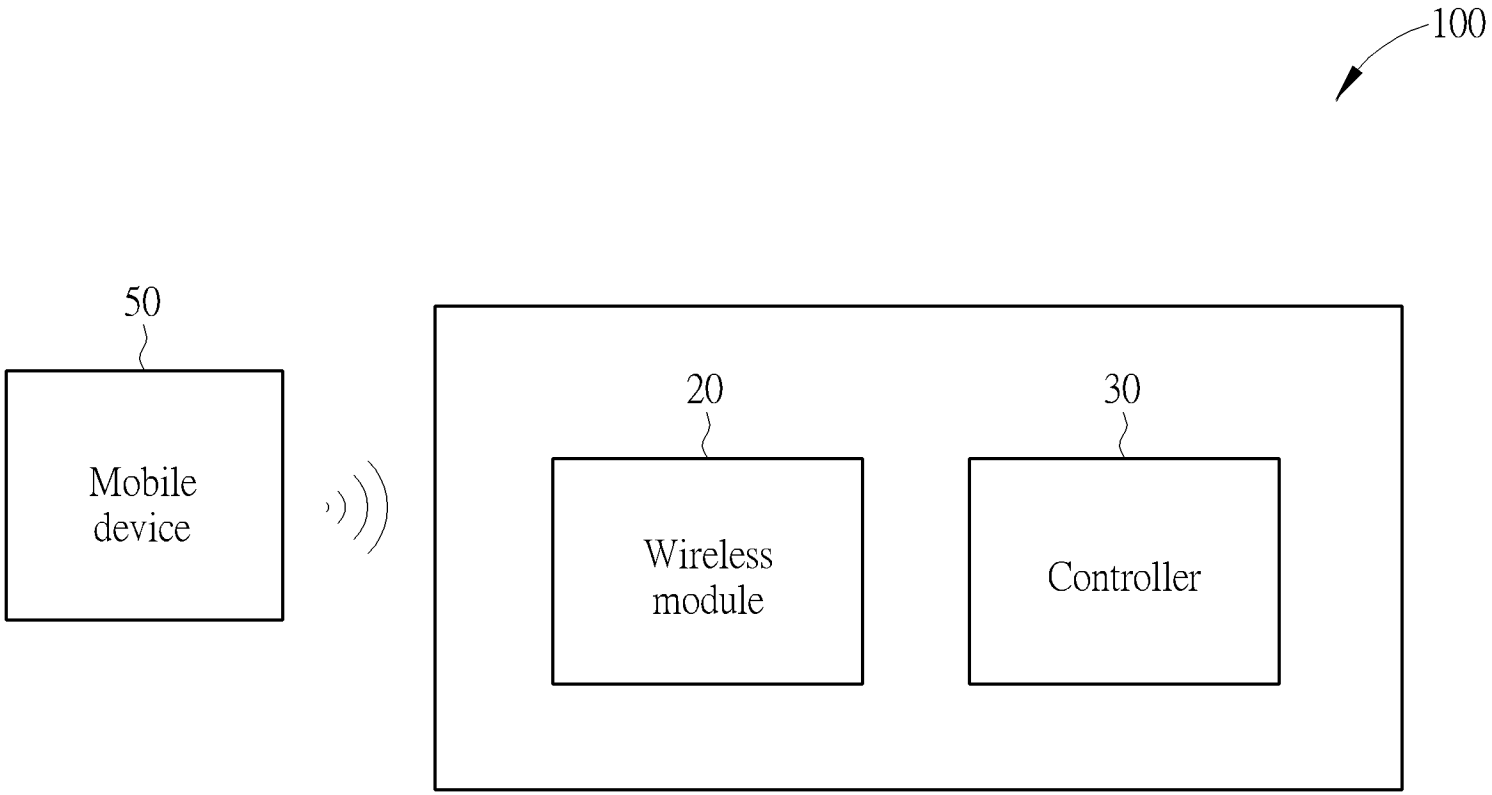
FIG. 1 is a diagram illustrating an electronic device arranged for controlling at least one peripheral device according to an embodiment of the present invention.

Refer to FIG. 1, which is a diagram illustrating an electronic device 100 arranged for controlling at least one peripheral device according to an embodiment of the present invention. By way of example, but not limitation, the electronic device 100 may include a wireless module 20 and a controller 30. The wireless module 20 is arranged to detect the existence of a mobile device 50 by checking the wireless connection associated with the mobile device 50, and more particularly, to detect the wireless connection between the electronic device 100 and the mobile device 50. The mobile device 50 may be an electronic device with a wireless communication function, e.g. a smart phone, a tablet, or a laptop computer that has the wireless fidelity (Wi-Fi) function. The electronic device 100 may be a Wi-Fi access point (AP) arranged for connecting the mobile device 50. In practice, the electronic device 100 can be one of various types of electronic devices with wireless communication abilities. Further, the aforementioned peripheral device may be a smart TV, a laptop computer, a game console, or an audio system that has the wireless fidelity (Wi-Fi) ability.

Although the Wi-Fi connection is detailed above, the present invention is not limited thereto. The Wi-Fi technique may be replaced with Bluetooth, infrared ray, near field communication (NFC), or radio frequency identification (RFID) techniques. Moreover, the present invention does not necessarily require the connection between the electronic device 100 and a peripheral device to be wireless. In some modifications of this embodiment, the connection between the electronic device 100 and a peripheral device may be arranged in a wired manner.

In this embodiment, the controller 30 of the electronic device 100 is arranged to obtain user data of the mobile device 50 through the wireless connection, and broadcast the user data of the mobile device 50 to the at least one peripheral device (e.g. one or more peripheral devices) when the controller 30 detects the existence of the mobile device 50, so as to control the setting of each peripheral device.

Figure 2:
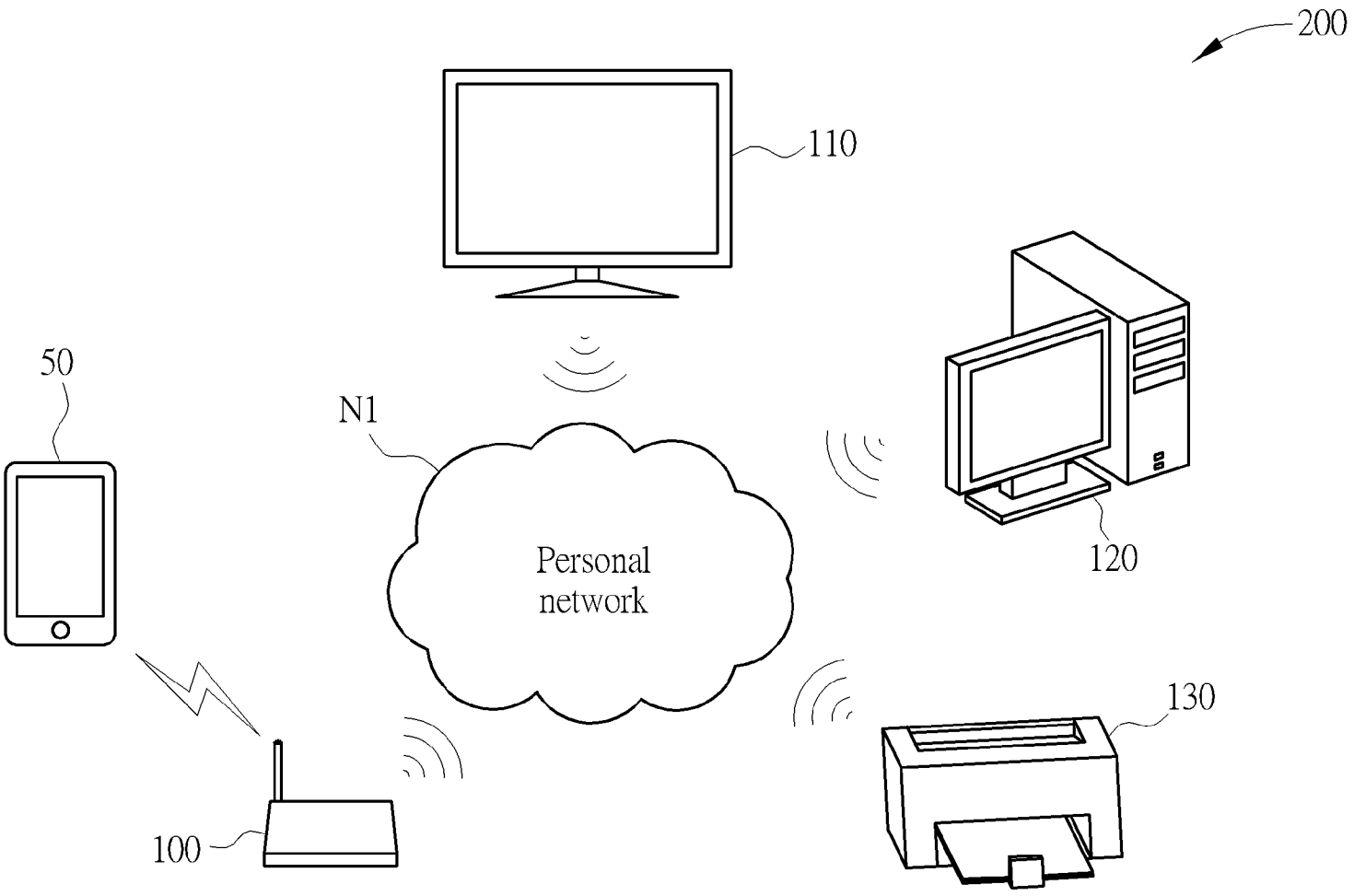
FIG. 2 is a diagram illustrating a scenario of applying the electronic device shown in FIG. 1 to a wireless system according to an embodiment of the present invention.

FIG. 2 is a diagram illustrating a scenario of applying the electronic device 100 shown in FIG. 1 to a wireless system 200 according to an embodiment of the present invention. By way of example, but not limitation, the wireless system 200 may be viewed as a household wireless system, and the electronic device 100 may be viewed as a Wi-Fi AP in this embodiment. The wireless system 200 further includes a plurality of peripheral device, i.e. a TV 110, a desktop computer 120 and a printer 130, wherein the electronic device 100, TV 110, desktop computer 120 and printer 130 are connected to each other through a personal network N1. In this embodiment, the electronic device 100 is arranged for connecting to the mobile device 50 and delivering information/commands received from the mobile device 50 to the TV 110, the desktop computer 120 and the printer 130 for controlling the TV 110, the desktop computer 120 and the printer 130 to enter a predetermined mode. In this way, the users of the mobile device 50 may instantly enjoy/experience the adjusted peripheral devices without wasting time setting the peripheral devices themselves.

Figure 3:
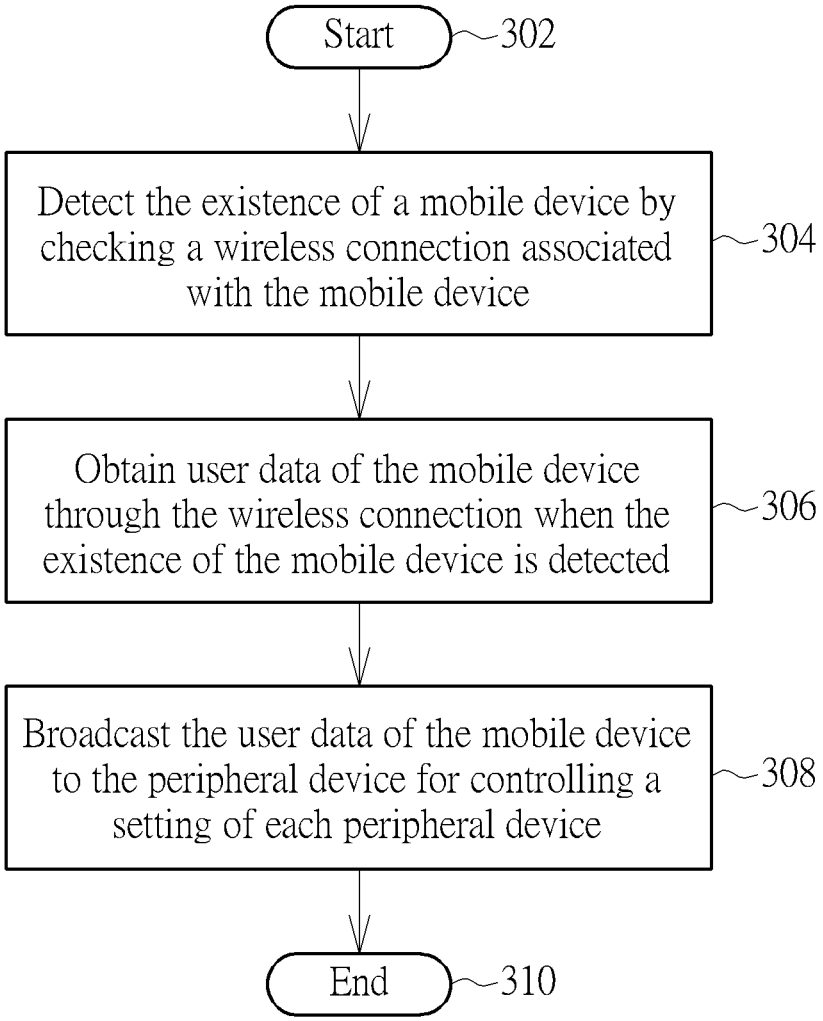
FIG. 3 is a flowchart illustrating a method for controlling at least one peripheral device according to an embodiment of the present invention.

FIG. 3 is a flowchart illustrating a method for controlling at least one peripheral device according to an embodiment of the present invention. The method may be employed by the wireless system 200 shown in FIG. 2. The method is detailed as follows.

Step 302: Start.

Step 304: Detect the existence of a mobile device by checking a wireless connection associated with the mobile device.

Step 306: Obtain user data of the mobile device through the wireless connection when the existence of the mobile device is detected.

Step 308: Broadcast the user data of the mobile device to the peripheral device for controlling a setting of each peripheral device.

Step 310: End.

In step 304, after the electronic device 100 detects the existence of the user's mobile device 50, the electronic device 100 will connect to the mobile device 50 through Wi-Fi communication, for example. After the connection between the electronic device 100 and the mobile device is constructed, the electronic device 100 will obtain user data from the mobile device 50 in step 306. The user data may include information/commands related to personal settings of the user, which instruct the electronic device 100 to enter a user-specified mode. In step 308, the electronic device 100 may broadcast information/commands related to personal settings of the user to peripheral devices such as the aforementioned TV 110, desktop computer 120 and printer 130, so that the peripheral devices may also enter the user-specified mode. The user may thereby enjoy a custom-made household environment without the need to individually set each of the peripheral devices.

Specific values of volume, brightness, and initial channels of the TV 110 may be automatically adjusted for the user, so that the user does not need to manually search for a preferred channel, or manually adjust the volume and brightness to user-preferred values. In another example, the sound mode and volume of an audio system (not shown) may be automatically prepared for the user, thus greatly improving the user experience.

Figure 4:
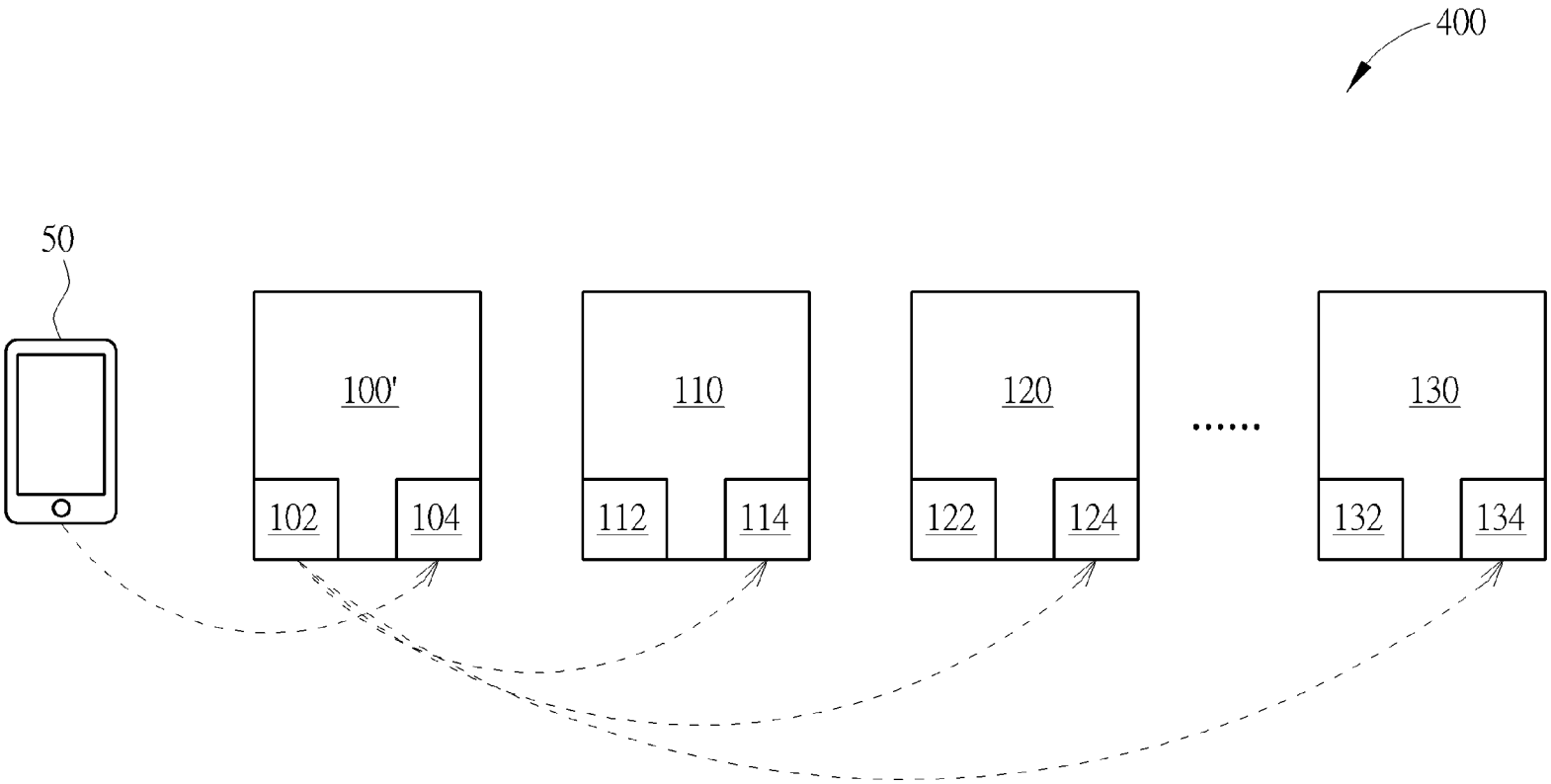
FIG. 4 is a diagram illustrating a control system performing the method shown in FIG. 3 according to an embodiment of the present invention.

Further, of the electronic device 100, the TV 110, desktop computer 120 and printer 130 may each have a respective broadcast module and a respective receiver module. FIG. 4 is a diagram illustrating a control system 400 for performing the method shown in FIG. 3 according to an embodiment of the present invention. The Wi-Fi AP 100' includes a receiver module 102 and a broadcast module 104, the TV 110 includes a receiver module 112 and a broadcast module 114, the desktop computer 120 includes a receiver module 122 and a broadcast module 124, and the printer 130 includes a receiver module 132 and a broadcast module 134. Please note that the Wi-Fi AP 100' may be an example of the aforementioned electronic device 100.

The Wi-Fi AP 100' detects the existence of the mobile device 50, and then the connection between the mobile device 50 and the Wi-Fi AP 100' will be constructed. Next, the receiver module 102 of the Wi-Fi AP 100' receives user information/commands from the mobile device 50, and enters a user-specified mode according to the received user information/commands, to control the setting of each of the peripheral devices (i.e. TV 110, desktop computer 120 and printer 130).

The receiver module 112 of the TV 110 receives the user information/commands from the broadcast module 104 of the Wi-Fi AP 100, and the TV 110 will enter the user-specified mode. Similarly, the desktop computer 120 and the printer 130 may enter the user-specified mode according to the received user information/commands. Hence, at the time the mobile device 50 successfully connects to the network, the peripheral devices connected to the same network may instantly enter the user-specified mode. When the user carries the mobile device 50 and approaches the peripheral devices, the peripheral devices are ready to be used in their respective preferred modes. The user does not need to further adjust the setting of any of the peripheral devices as long as the setting of each of the peripheral devices has been set once.

Please note that, although all peripheral devices belong to the same network in this embodiment, the present invention is not limited thereto. In some modifications of this embodiment, the peripheral devices may belong to different networks. Moreover, the connections between the mobile devices and the peripheral devices can be either wireless or arranged in a wired manner. Further, the present invention does not limit the mobile device 50 to connecting to a Wi-Fi AP first and/or the electronic device 100 being a Wi-Fi AP.

Figure 5:
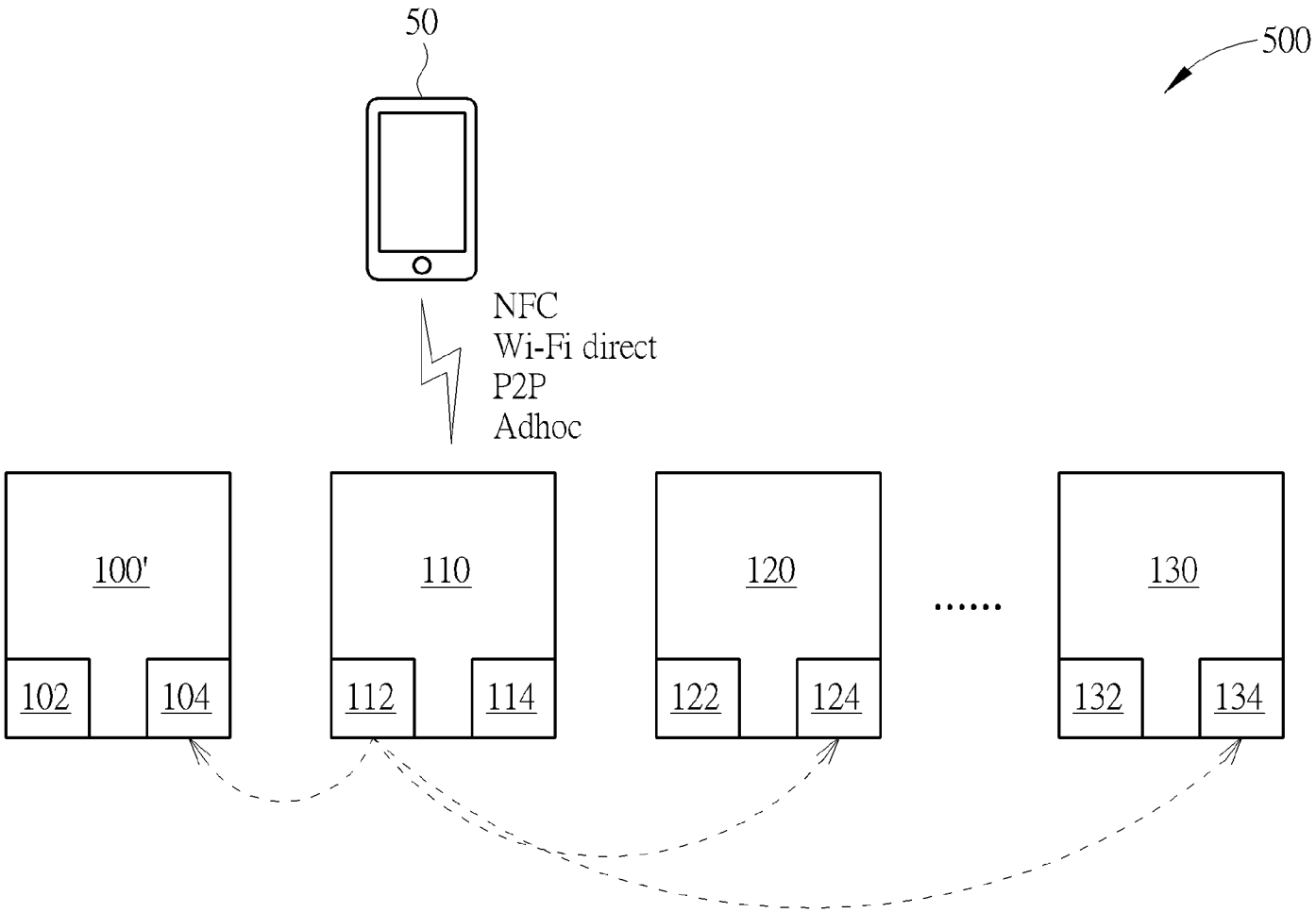
FIGS. 5-7 are diagrams illustrating control systems performing the method shown in FIG. 3 according to other embodiments of the present invention.
Figure 6:
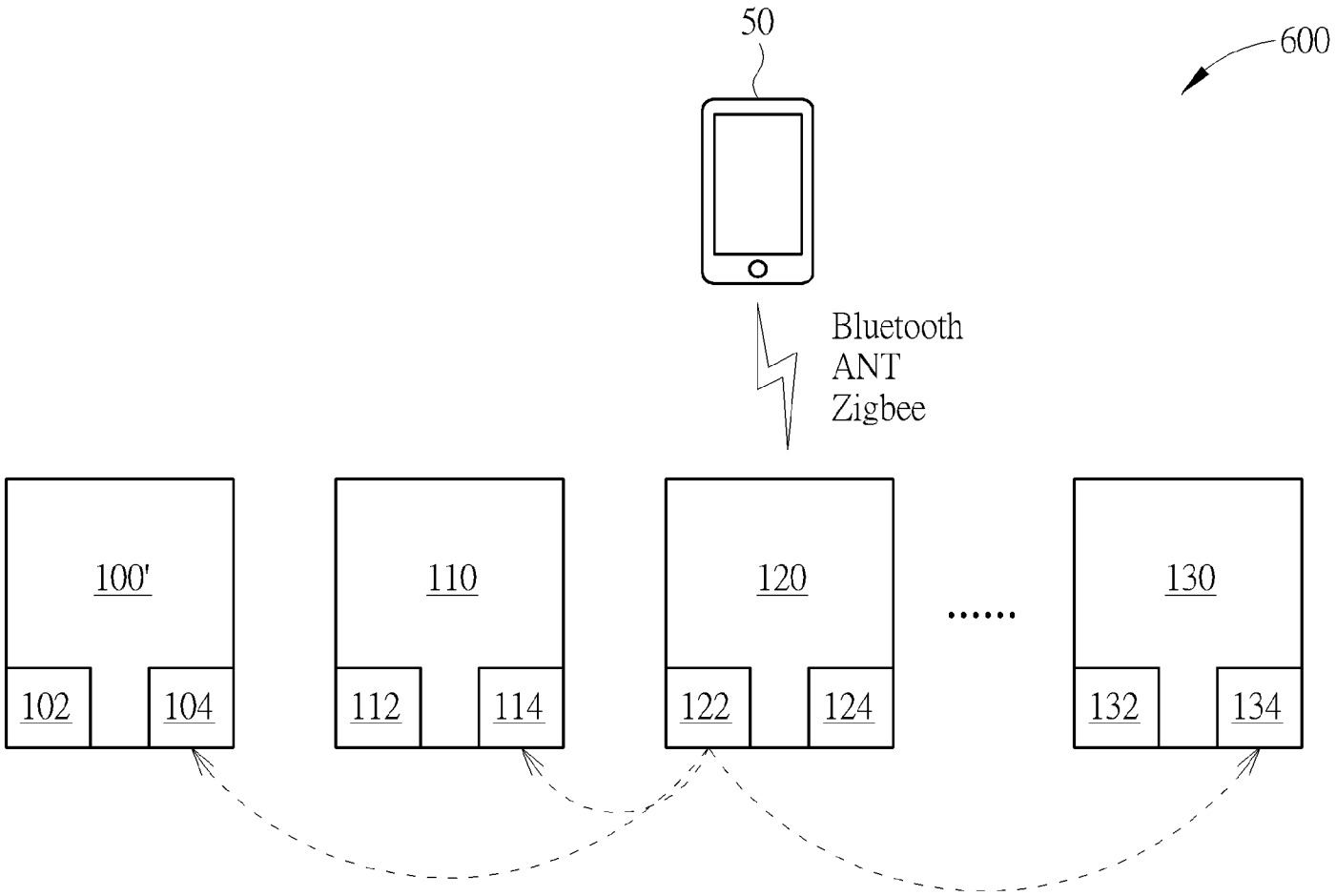
Figure 7:
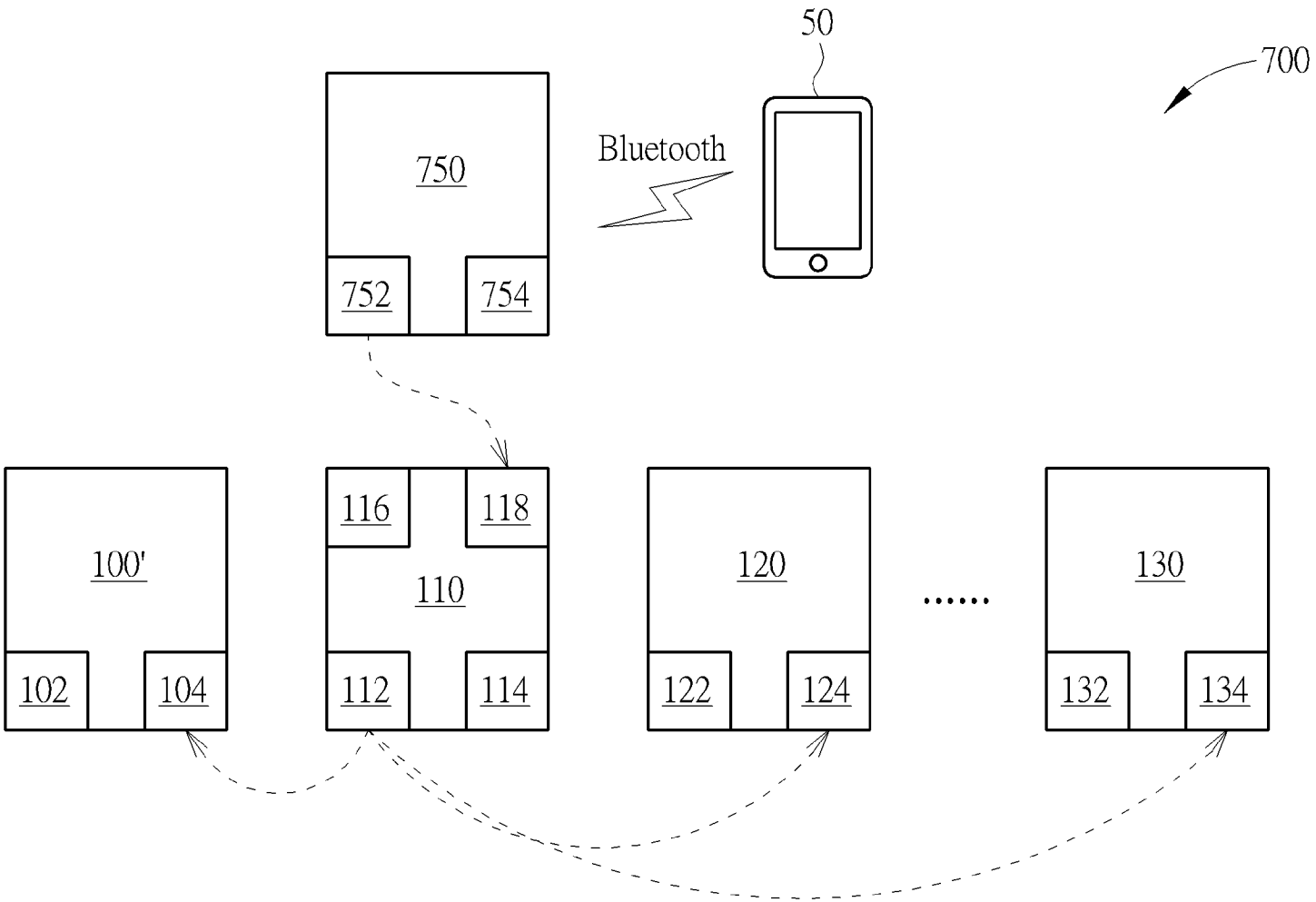

FIGS. 5-7 are diagrams illustrating control systems 500-700 for performing the method shown in FIG. 3 according to other embodiments of the present invention. The difference between the embodiments in FIG. 4 and FIG. 5 is that the mobile device 50 of the control system 500 is initially connected to the TV 110 through any of the Wi-Fi direct, peer-to-peer (P2P), and Adhoc techniques, rather than connected to a Wi-Fi AP. After the connection between the mobile device 50 and the TV 110 is constructed, the receiver module 114 of the TV 110 receives the user information/commands from the mobile device 50. Then, the TV 110 may broadcast the user information/commands to the Wi-Fi AP 100', the desktop computer 120 and the printer 130, respectively. Specifically, the broadcast module 112 of the TV 110 may broadcast the user information/commands to the receiver module 104' of the Wi-Fi AP 100', the receiver module 124 of the desktop computer 120, and the receiver module 134 of the printer 130, respectively.

For the embodiment shown in FIG. 6, the mobile device 50 of the control system 600 is initially connected to the desktop computer 120 through any of the Bluetooth, ANT, and Zigbee techniques. Then, the desktop computer 120 may broadcast the user information/commands to the Wi-Fi AP 100', TV 110 and printer 130, respectively. The broadcast module 122 of the desktop computer 120 may broadcast the user information/commands to the receiver module 104' of the Wi-Fi AP 100', the receiver module 114 of the TV 110 and the receiver module 134 of the printer 130, respectively.

It can be seen from the embodiments shown in FIGS. 4-6 that, after the mobile device 50 is connected to a first peripheral device, the first peripheral device will be controlled to enter the user-specified mode, and other peripheral devices may also be controlled to enter the user-specified mode through receiving the user information/commands from the first peripheral device. The first peripheral device may be viewed as an intermediate device arranged for controlling the other peripheral devices.

Although the above embodiments merely utilize one intermediate device to control the peripheral devices, the present invention is not limited thereto. For example, as shown in FIG. 7, the control system 700 further includes a Bluetooth speaker 750 which has a broadcast module 752 and a receiver module 754, and the TV 110 includes another broadcast module 116 and another receiver module 168, wherein the broadcast module 116 and the receiver module 168 may be arranged to perform the transmission between the TV 110 and another electronic device (e.g. the Bluetooth speaker 750). In this embodiment, the mobile device 50 is initially connected to the Bluetooth speaker 750 through the Bluetooth technique, and the broadcast module 752 of the Bluetooth speaker 750 then broadcasts the user information/commands to the receiver module 168 of the TV 110. After that, the TV 110 may broadcast the user information/commands received from the Bluetooth speaker 750 to other peripheral devices. Specifically, the broadcast module 112 of the TV 110 may broadcast the user information/commands to the receiver module 104' of the Wi-Fi AP 100', the receiver module 124 of the desktop computer 120 and the receiver module 134 of the printer 130, respectively. Note that the broadcast module 116 of the TV 110 may be used to broadcast the user information/commands to other peripheral device. Through the above configuration, the information/commands of the mobile device 50 is delivered to the peripheral devices (i.e. the desktop computer 120 and the receiver module 134 of the printer 130) through two intermediate devices. In some modifications of this embodiment, however, more electronic devices may be arranged to be intermediate.

Figure 8:
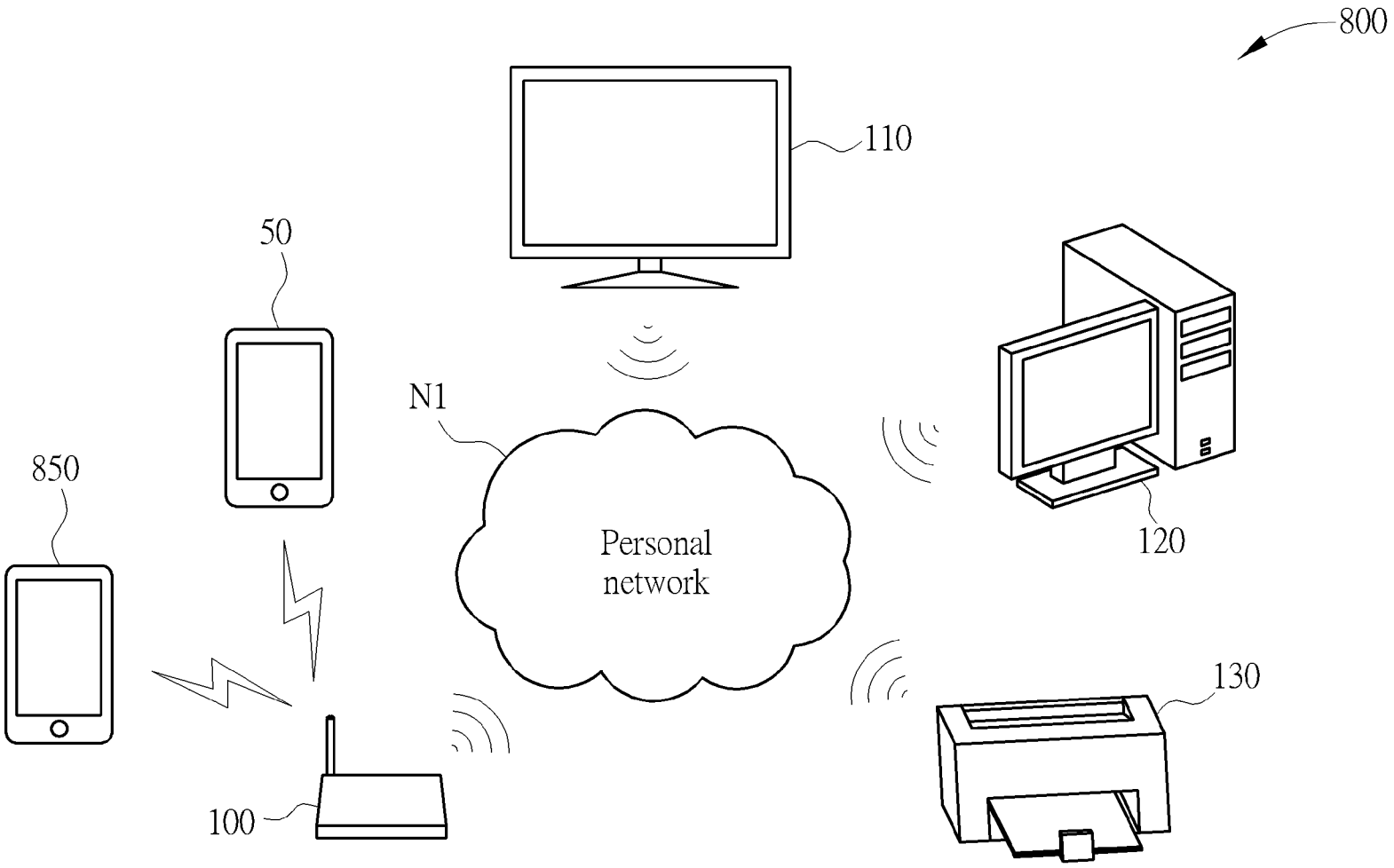
FIG. 8 is a diagram illustrating another scenario of applying the electronic device shown in FIG. 1 to the wireless system according to another embodiment of the present invention.

FIG. 8 is a diagram illustrating another scenario of applying the electronic device 100 shown in FIG. 1 to the wireless system 800 according to another embodiment of the present invention. The wireless system 800 may be viewed as a household wireless system, and the electronic device 100 may be viewed as a Wi-Fi AP in this embodiment. The wireless system 800 includes the aforementioned TV 110, desktop computer 120 and printer 130, wherein the electronic device 100, TV 110, desktop computer 120 and printer 130 are connected to each other through a personal network N1. In this embodiment, the wireless module 20 of the electronic device 100 further detects the existence of another mobile device 850 by checking another wireless connection associated with the mobile device 850. The mobile device 850 may be viewed as another mobile device carried by another user, i.e. in the proximity of the electronic device 100 there are two different users with mobile devices 50 and 850, respectively. When the co-existence of mobile devices 50 and 850 is detected by the wireless module 20, the controller 30 of the electronic device 100 is arranged to control one of the mobile devices 50 and 250 to prepare a user interface (UI) for selection between multiple user-specified modes. In some modifications of this embodiment, both of the mobile devices 50 and 250 may be controlled to prepare respective user interfaces. This embodiment may be applied to a multi-user scenario, and provides a method for preventing the peripheral devices from entering an undesired mode. Hence, even if a peripheral device stores the settings of both the mobile devices 50 and 850, the user may still control this peripheral device to enter their own predetermined mode. The operation for selecting the specific user-defined mode can be simple. For example, the user may perform the above operation via a touch screen on a mobile device such as a smart phone or a tablet.

The user interface is arranged to receive a user mode selection input, and obtain the user data of the mobile device (e.g. mobile device 50 or 850) through the wireless connection (i.e. the personal network N1) in response to the user mode selection input. The user interface may be displayed on a touch panel, and the user may generate the user mode selection input through touching the user interface of the mobile device (e.g. mobile device 50 or 850), which controls the peripheral devices to enter a user-specified mode used by the mobile device. Even if multiple mobile devices coexist in the same wireless environment, the method arranged for controlling peripheral devices described in the previous embodiments can still function normally in this wireless environment. This means the present invention can be applied to various wireless/wired environments regardless of the number of users.

Figure 9:
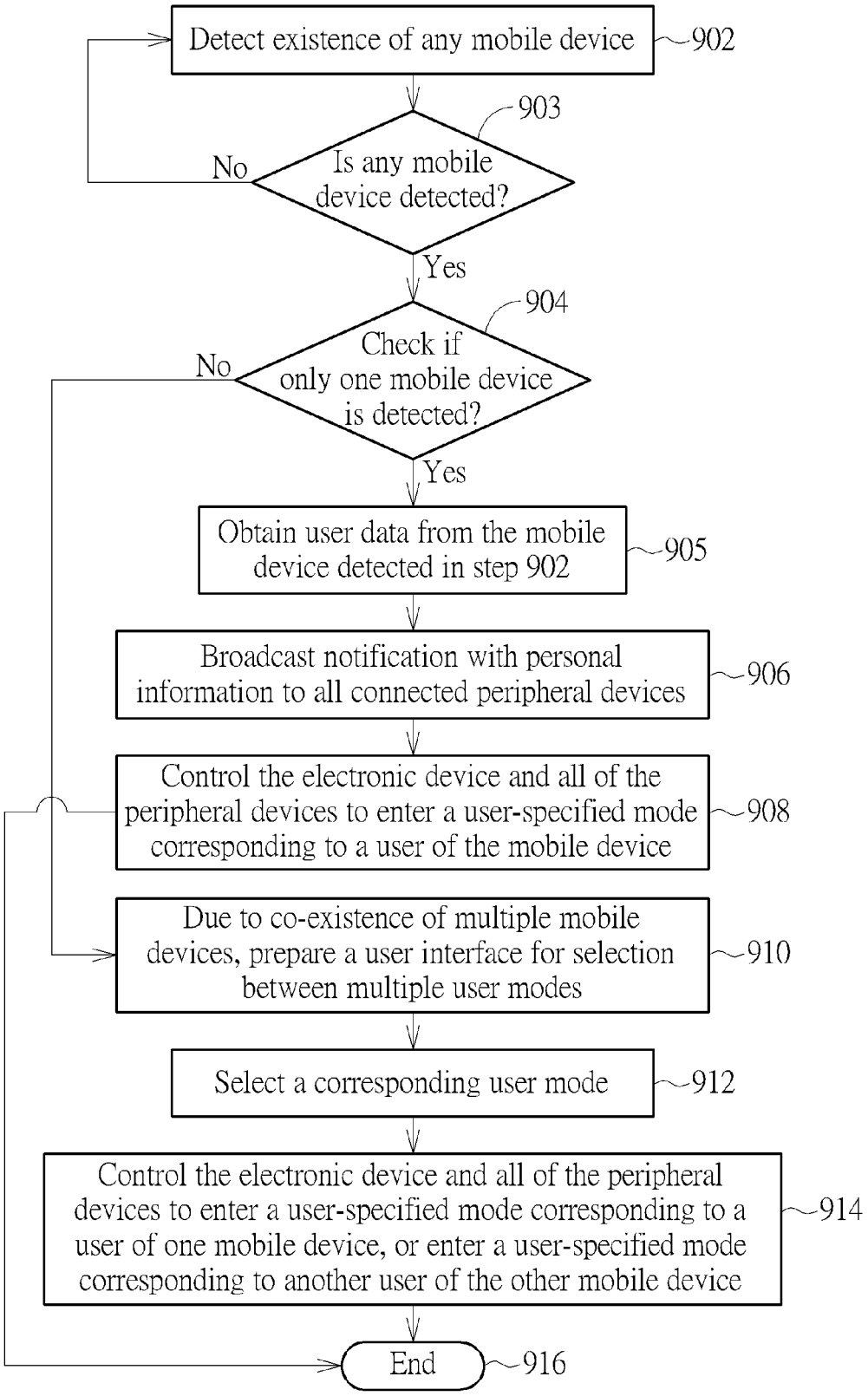
FIG. 9 is a diagram illustrating a workflow applied to the scenario of FIG. 8.

FIG. 9 is a diagram illustrating a workflow applied to the scenario of FIG. 8. The workflow is detailed as follows.

Step 902: Detect existence of any mobile device.

Step 903: Is any mobile device detected? If yes, go to step 904; otherwise, repeat step 902.

Step 904: Check if only one mobile device is detected. If yes, go to step 905; otherwise, go to step 910.

Step 905: Obtain user data from the mobile device detected in step 902.

Step 906: Broadcast notification with personal information to all connected peripheral devices.

Step 908: Control the electronic device and all of the peripheral devices to enter a user-specified mode corresponding to a user of the mobile device. Go to step 916.

Step 910: Due to co-existence of multiple mobile devices, prepare a user interface for selection between multiple user modes.

Step 912: Select a corresponding user mode.

Step 914: Control the electronic device and all of the peripheral devices to enter a user-specified mode corresponding to a user of one mobile device, or enter a user-specified mode corresponding to another user of the other mobile device.

Step 916: End.

Figure 10:
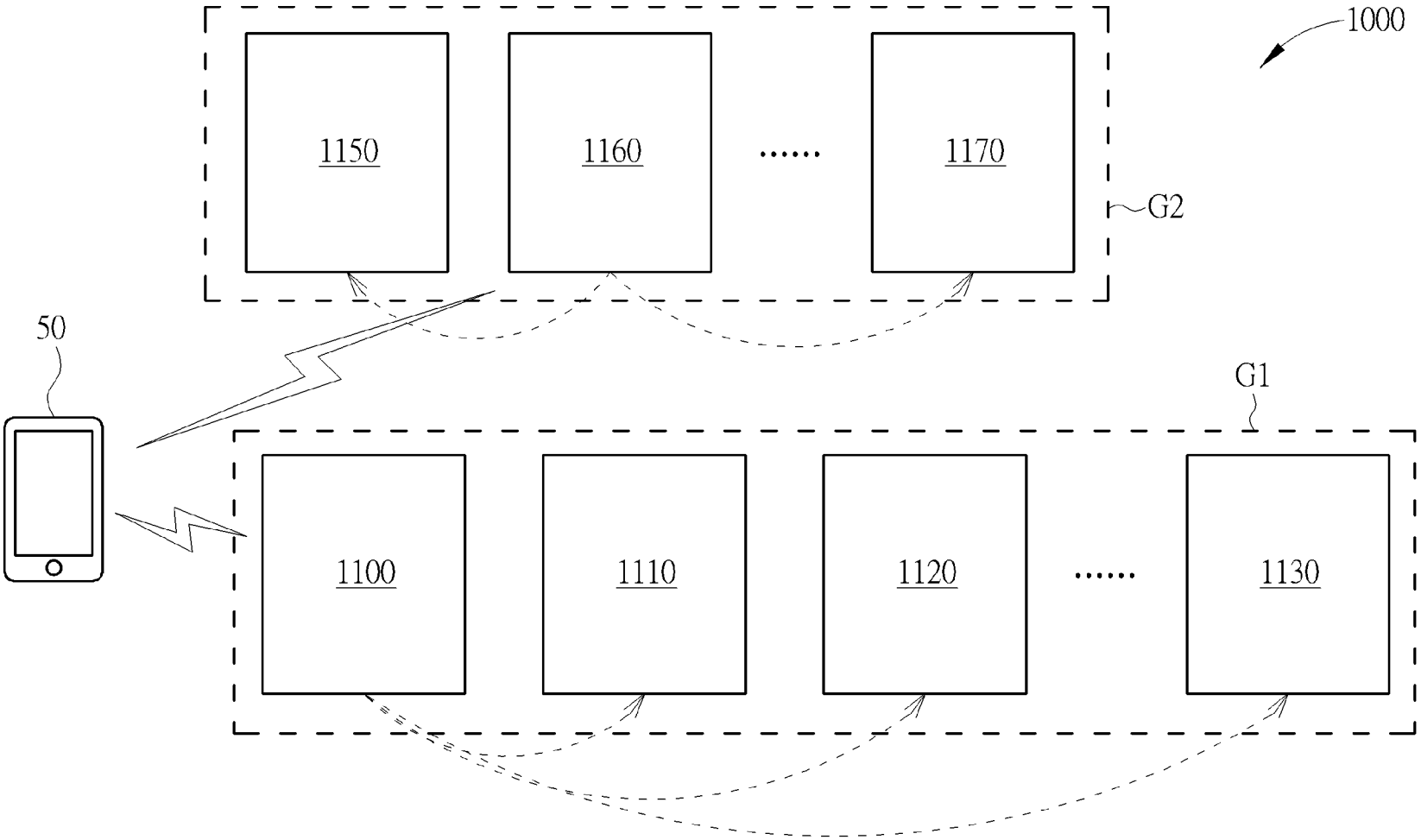
FIG. 10 is a diagram illustrating a control system according to another embodiment of the present invention.

FIG. 10 is a diagram illustrating a control system 1000 according to another embodiment of the present invention. The control system 1000 includes a plurality of groups (e.g. groups G1 and G2), each having an electronic device arranged for controlling at least one peripheral devices. For example, the group G1 includes a Wi-Fi AP 1100 and a plurality of peripheral devices (e.g. the notebook 1110, the desktop computer 1120 and the printer 1130). The group G2 includes a TV 1160 having a network function and a plurality of peripheral devices (e.g. the notebook DVD player 1150 and the refrigerator 1170). Note that the connections between the elements in any of the groups G1 and G2 can be wireless or wired.

When the mobile device 50 approaches the Wi-Fi AP 1100 and the TV 1160, the Wi-Fi AP 1100 and the TV 1160 will detect the existence of the mobile device 50. Then, the connection between the mobile device 50 and the Wi-Fi AP 100' and the connection between the mobile device and the TV 1160 will be constructed. Next, user information/commands will be delivered from the mobile device 50 to all the peripheral devices in groups G1 and G2. In this way, all the peripheral devices belonging to different groups may enter the user-specified mode, to control the setting of each peripheral device. Hence, the mobile device 50 in this embodiment may control multiple groups belonging to different networks. Further, as mentioned above, each of the peripheral devices may also include a receiver module and a broadcast module for data transmissions. The features of this embodiment are identical to those of the previous embodiments, and are omitted here for brevity.

Figure 11:
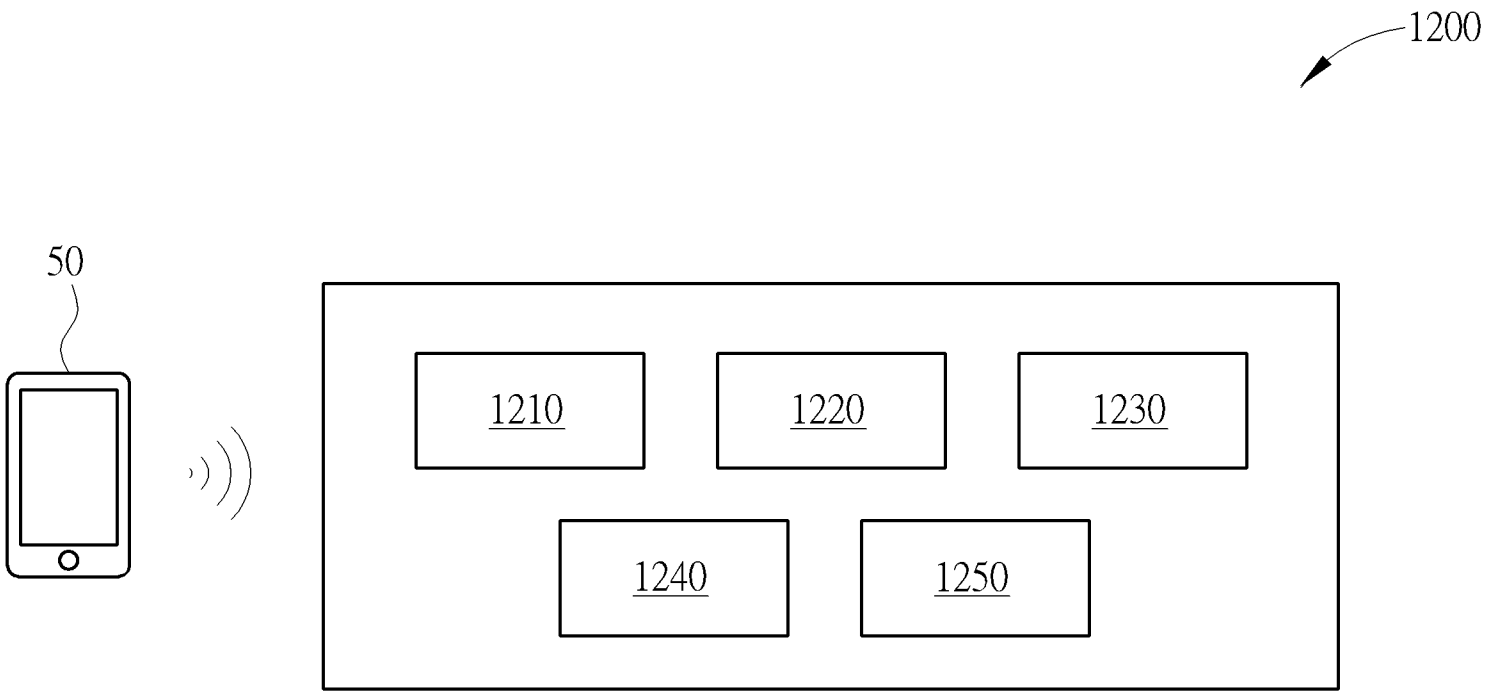
FIG. 11 is a diagram illustrating a car system according to an embodiment of the present invention.

By way of example, the concept of the above embodiments may be applied to a car system. FIG. 11 is a diagram illustrating a car system 1200 according to an embodiment of the present invention. As shown in FIG. 11, the car system 1200 includes a Bluetooth car kit 1210 and a plurality of peripheral devices, such as a radio device 1220, an air conditioner device 1230, a driving mode controller 1240 and a seat controller 1250. For example, when the user carries the mobile device 50 and approaches the Bluetooth car kit 1210, the existence of the mobile device 50 will be detected by the Bluetooth car kit 1210. Then, the connection between the mobile device 50 and the Bluetooth car kit 1210 will be constructed. After the connection between the Bluetooth car kit 1210 and the mobile device 50 is constructed, the Bluetooth car kit 1210 will obtain user data of the mobile device 50. The user data includes information/commands related to personal settings of the user, which instruct the Bluetooth car kit 1210 to enter a user-specified mode. The Bluetooth car kit 1210 may broadcast information/commands related to personal settings of the user to peripheral devices such as the radio device 1220, the air conditioner device 1230, the driving mode controller 1240 and the seat controller 1250. Similarly, each of the above peripheral devices implemented in the car system 1200 may have a broadcast module and a receiver module. The features of this embodiment are identical to those of the previous embodiments, and are omitted here for brevity.

Through utilizing the method and devices provided in this embodiment, the user may instantly enjoy a custom-made vehicle environment without individually setting parameters of each of the peripheral devices, such as the air conditioner temperature, the music volume, or the height and depth of the driver seat. More particularly, the user may save the time required for adjusting each peripheral device into a respective desired mode.

To summarize, the embodiments of the present invention provide a novel method for controlling at least one peripheral device (e.g. one or more peripheral device) near the user to instantly enter a user-defined mode, which saves on time required for individually adjusting peripheral devices to a desired mode. In this way, the user experience can be improved greatly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for controlling at least one peripheral device, comprising:

utilizing an electronic device to detect existence of a first mobile device by checking a wireless connection associated with the first mobile device; and when the existence of the first mobile device is detected, obtaining user data of the first mobile device through the wireless connection, and broadcasting the user data of the first mobile device to the at least one peripheral device for controlling a setting of each peripheral device;

wherein the electronic device, the first mobile device and the at least one peripheral device are distinct devices.

2. The method of claim 1, further comprising:

detecting existence of a second mobile device by checking another wireless connection associated with the second mobile device;

when co-existence of the first mobile device and the second mobile device is detected, controlling one of the first mobile device and the second mobile device to prepare a user interface for selection between multiple user modes, and receiving a user mode selection input of the user interface;

wherein the step of obtaining the user data of the first mobile device through the wireless connection comprises:

in response to the user mode selection input, obtaining the user data of the first mobile device through the wireless connection.

3. The method of claim 1, wherein the wireless connection is a wireless fidelity (Wi-Fi) connection.

4. The method of claim 3, wherein the method is performed on a Wi-Fi access point.

5. The method of claim 1, wherein the wireless connection is a Bluetooth connection.

6. The method of claim 5, wherein the method is performed on a Bluetooth car kit, and the peripheral device includes at least one of a radio device, an air conditioner device, a driving mode controller and a seat controller.

7. The method of claim 1, wherein the wireless connection is a near field communication (NFC) connection.

8. The method of claim 7, wherein the method is performed on a desktop computer.

9. An electronic device for controlling at least one peripheral device, comprising:

a wireless module, arranged to detect existence of a first mobile device by checking a wireless connection associated with the first mobile device; and a controller, arranged to obtain user data of the first mobile device through the wireless connection and broadcast the user data of the first mobile device to the at least one peripheral device when the existence of the first mobile device is detected, so as to control a setting of each peripheral device;

wherein the electronic device, the first mobile device and the at least one peripheral device are distinct devices.

10. The electronic device of claim 9, wherein:

the wireless module is further arranged to detect existence of a second mobile device by checking another wireless connection associated with the second mobile device; and when co-existence of the first mobile device and the second mobile device is detected, the controller is arranged to control one of the first mobile device and the second mobile device to prepare a user interface for selection between multiple user modes, receive a user mode selection input of the user interface, and obtain the user data of the first mobile device through the wireless connection in response to the user mode selection input.

11. The electronic device of claim 9, wherein the wireless connection is a wireless fidelity (Wi-Fi) connection.

12. The electronic device of claim 11, being a Wi-Fi access point.

13. The electronic device of claim 9, wherein the wireless connection is a Bluetooth connection.

14. The electronic device of claim 13, being a Bluetooth car kit, wherein the peripheral device includes at least one of a radio device, an air conditioner device, a driving mode controller and a seat controller.

15. The electronic device of claim 9, wherein the wireless connection is a near field communication (NFC) connection.

16. The electronic device of claim 15, wherein being a desktop computer.

17. A control system for controlling a plurality of peripheral devices, comprising:

a plurality of groups, each having an electronic device and at least one peripheral device, the electronic device comprising:

a wireless module, arranged to detect existence of a mobile device by checking a wireless connection associated with the mobile device; and a controller, arranged to obtain user data of the mobile device through the wireless connection and broadcast the user data of the mobile device to the at least one peripheral device in the group to which the electronic device belongs when the existence of the mobile device is detected, so as to control a setting of each peripheral device in the group to which the electronic device belongs;

wherein the electronic device, the mobile device and the at least one peripheral device are distinct devices.

* * * * *